343-756 SR
12/18/84 XR 4,489,331

United States Patent [19]
Salvat et al.
[11] Patent Number: 4,489,331
[45] Date of Patent: Dec. 18, 1984

[54] TWO-BAND MICROWAVE ANTENNA WITH NESTED HORNS FOR FEEDING A SUB AND MAIN REFLECTOR

[75] Inventors: Francois Salvat; Jean Bouko; Claude Coquio, all of Paris, France

[73] Assignee: Thomson-CSF, Paris, France

[21] Appl. No.: 341,580

[22] Filed: Jan. 21, 1982

[30] Foreign Application Priority Data

Jan. 23, 1981 [FR] France ..... 81 01286

[51] Int. Cl.[3] ..... H01Q 13/00; H01Q 5/00; H01Q 15/23

[52] U.S. Cl. ..... 343/753; 343/756; 343/777; 343/781 CA

[58] Field of Search ..... 343/781 P, 781 CA, 756, 343/776, 778, 786, 753, 755, 772, 779, 781 R, 777

[56] References Cited

U.S. PATENT DOCUMENTS

| | | | |
|---|---|---|---|
| 2,425,488 | 8/1947 | Peterson et al. | 343/776 |
| 3,495,262 | 2/1970 | Paine | 343/786 |
| 3,665,481 | 5/1972 | Low et al. | 343/786 |
| 3,825,932 | 7/1974 | Hockham | 343/776 |
| 4,096,482 | 1/1978 | Walters | 343/776 |
| 4,220,957 | 9/1980 | Britt | 343/756 |
| 4,241,353 | 12/1980 | Salvat et al. | 343/786 |

FOREIGN PATENT DOCUMENTS

| | | |
|---|---|---|
| 2626926 | 12/1977 | Fed. Rep. of Germany . |
| 2118848 | 4/1972 | France . |

OTHER PUBLICATIONS

Drabowitch, "Multimode Antennas", Microwave Journal, Jan. 1966.
Drabowitch, "Theory and Application of Multimode Antennas", CFTH Technical Review, Nov. 1962.
Von Trentini, "Review of Presently Employed Narrow-Beam Microwave Antennas", Jun. 1975.

*Primary Examiner*—Eli Lieberman
*Assistant Examiner*—Michael C. Wimer
*Attorney, Agent, or Firm*—Karl F. Ross; Herbert Dubno

[57] ABSTRACT

A two-band multimode microwave source for an antenna of a low-elevation-tracking radar comprises a higher-frequency section nested in a lower-frequency section, the two sections having E-planes perpendicular to each other. The lower-frequency section includes two outer pairs of waveguides separated by a block which convergingly projects beyond their output ends and is bisected by the E-plane of that section. The higher-frequency section includes two inner pairs of waveguides disposed within that block and separated by an obstruction lying in the last-mentioned E-plane. The higher-frequency wave emitted by the inner waveguides is made planar by a lens disposed at n output aperture of the structure which is transparent to the lower-frequency wave. In a Cassegrain-type radar antenna the lower-frequency wave emitted by the source is returned by a semitransparent intermediate reflector toward a main reflector provided with a grid which rotates its plane of polarization to let it pass out through the intermediate reflector along with the higher-frequency wave which, passing unattenuated through the intermediate reflector, is returned by a solid outlying reflector to the main reflector.

8 Claims, 5 Drawing Figures

FIG_1
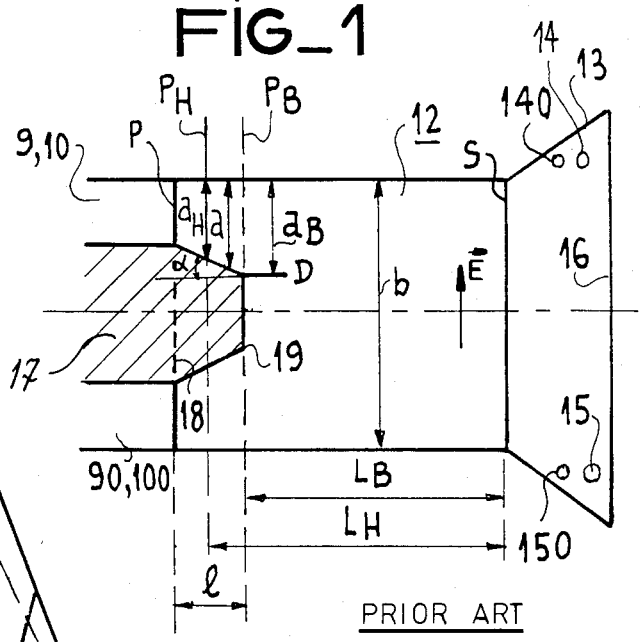
PRIOR ART
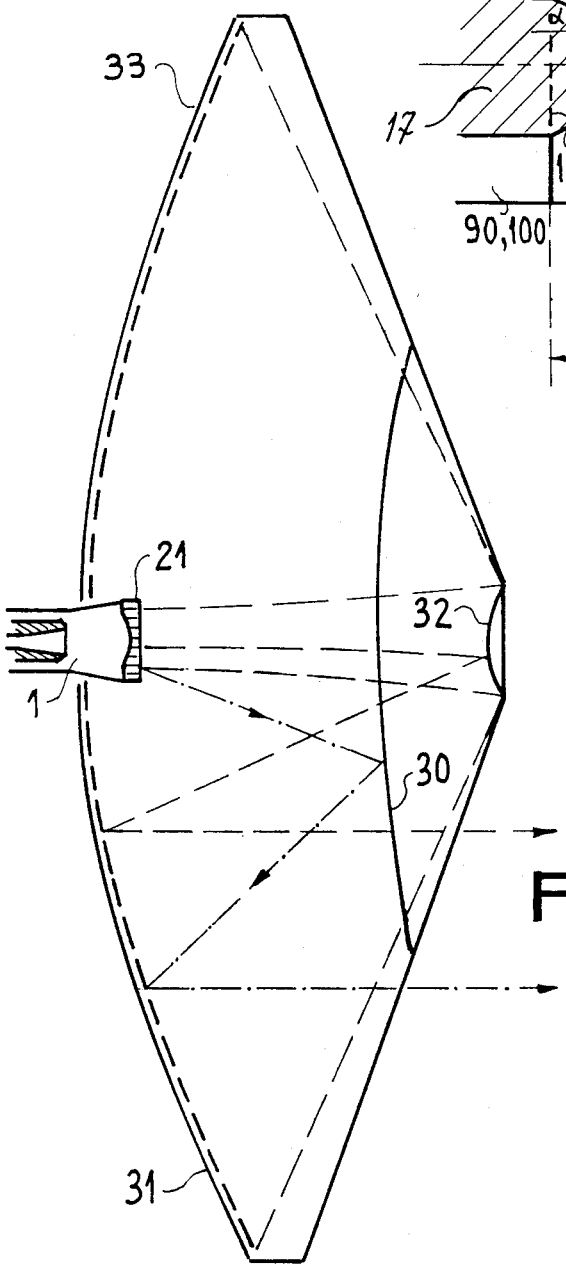
FIG_5

TWO-BAND MICROWAVE ANTENNA WITH NESTED HORNS FOR FEEDING A SUB AND MAIN REFLECTOR

FIELD OF THE INVENTION

Our present invention relates to a monopulse, multimode two-band microwave source and to antenna systems in which a source of this type is employed.

BACKGROUND OF THE INVENTION

At the present time, the technique of low-elevation tracking radars is showing a trend toward two-band radars. The low-frequency band (I-band, for example) permits correct tracking down to a predetermined angle of elevation above the horizon. In the case of angles of elevation which are smaller than this predetermined value, a higher-frequency band is adopted (W-band, for example), thus producing a much narrower beam.

However, in the prior art, sources respectively operating in these bands are separated, thus giving rise to difficulties in regard to coincidence of the radiation axes and resulting in unsatisfactory operation of the system.

OBJECT OF THE INVENTION

According to the invention, these difficulties by providing a single source which is capable of radiating within both frequency bands considered.

It hardly seems necessary to dwell upon the advantages arising from the use of a single antenna supplied by a source which is thus designed to operate within both frequency ranges, in regard to construction and installation costs as well as ease of maintenance.

We have already studied multimode microwave sources and the antenna systems in which such sources are used. In particular, these studies have led to developments described in our commonly owned U.S. Pat. Nos. 4,241,353 and 4,357,612.

SUMMARY OF THE INVENTION

According to our present invention, we provide a wide-band multimode two-band microwave source, preferably of the monopulse type, comprising a unit with a first cavity supplied by a first excitation waveguide assembly in its fundamental mode with a first wave lying in a lower frequency band, and a profiled block (termed "obstruction" in our U.S. Pat. No. 4,357,612) projecting into that cavity to define the mode of propagation in the E-plane of this first wave, the profiled block being hollow and its interior forming a second cavity into which opens another excitation waveguide assembly transmitting in its fundamental mode a second wave lying in a higher frequency band. The second cavity opens into the first cavity so as to form therewith two nested sections capable of simultaneously transmitting the waves propagated therein.

BRIEF DESCRIPTION OF THE DRAWING

These and other features of our invention will now be described in detail with reference to the accompanying drawing wherein:

FIG. 1 is in axial sectional view of a single-band multimode wide-band source according to our prior U.S. Pat. No. 4,357,612;

FIG. 5 is a schematic axial sectional view of an antenna equipped with a source according to the invention.

SPECIFIC DESCRIPTION

Figure 2:
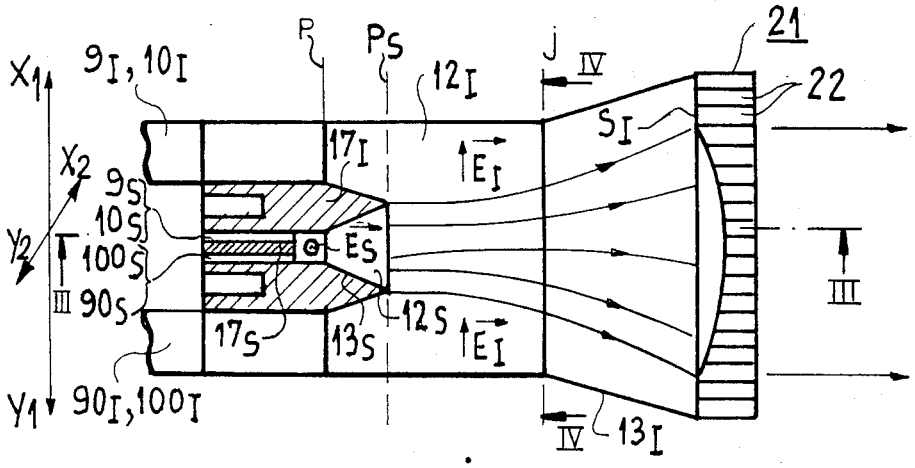
FIG. 2 is a sectional view taken along the same plane as FIG. 1 and showing a two-band source according to our invention.

FIG. 1, labeled PRIOR ART, is a sectional view taken along a longitudinal plane containing the electric field vector (E-plane) of a wide-band multimode source as disclosed in our U.S. Pat. No. 4,357,612. The same notations have been adopted in order to simplify the description. The source essentially comprises a cavity 12, whose aperture is located in a plane S beyond which can be placed an H-plane 8 moder (more fully discussed hereinafter) which will constitute together with the E-plane moder a composite E-plane, H-plane microwave source. Four waveguides 9, 10, 90, 100 open into that cavity and adjoin one another in pairs along respective partitions, such as those shown at 11 and 110 in FIG. 4, interposed between the upper-position waveguides 9, 10 and between the lower-position waveguides 90, 100.

A profiled obstruction 17 projects through part of a so-called discontinuity plane which is parallel to the electric field E and forms the downstream boundary of the upper and lower waveguides. Depending on the frequency, the shape and dimensions of obstruction 17 have a different effect upon the modes created within the region in which the obstruction is located. As shown the obstruction projects into the interior of the cavity 12 with a decreasing cross-section.

More particularly, obstruction 17 is a block having a cross-section of trapezoidal shape whose large base 18 is located in the plane P coinciding with the output ends of the supply waveguides 9, 10 and 90, 100. The small base 19 of the trapezoid is located in a plane $P_B$ at a distance l from the plane P within the interior of the cavity 12 and at a distance $a_B$ from the cavity walls as measured parallel to the electric field $\vec{E}$. The distance a changes progressively from the small base to the large base.

The sides of the block 17 between the large base and the small base include an angle $\alpha$ with the direction D which is perpendicular to the planes P and $P_B$. The moder has a height b in its vertical dimension parallel to field vector $\vec{E}$, indicated at $X_1$-$Y_1$ in FIGS. 2 and 3. The moder also has a width c in the horizontal dimension $X_2$—$Y_2$ as indicated in FIG. 3.

The cavity 12 bounded by planes $P_B$ and S defines a transition zone terminating in a horn 13 whose wide end 16 constitutes the source aperture. In accordance with known practice, and as described in particular in our prior U.S. Pat. No. 4,241,353, an H-plane moder can be constructed by means of rods 14, 140 and 15, 150 extending parallel to direction $X_2$-$Y_2$ within the horn 13.

In the operation of the source shown in FIG. 1, by reason of the shape of the block 17 having one of its bases located in the so-called discontinuity plane P, the higher modes and principally the hybrid mode $EM_{12}$ are not created at the plane P but occur in different short-circuit planes according to their frequency within the operating band.

Thus, at the lower frequencies of the band, the excitation plane of the hybrid mode $EM_{12}$ is the aforementioned plane $P_B$ containing the small base of the forwardly converging block 17. The phasing length is then $L_B$, that is, the distance between the plane $P_B$ and the aperture plane S of the moder proper. The modulus of the mode ratio is given in this instance by to the following expression:

$$|\beta| = \frac{2 \sin 2 \pi \frac{a_B}{b}}{2 \frac{a_B}{b}}$$

At the higher frequencies of the band, the excitation plane of the hybrid mode $EM_{12}$ is located at $P_H$, which is in the intermediate position between the plane P and the plane $P_B$. The phasing length is $L_H$, that is, the distance between the plane $P_H$ and the aperture plane S. The modulus of the mode ratio is then given by the following expression:

$$|\beta| = \frac{2 \sin \frac{2 \pi a_H}{b}}{2 \frac{a_H}{b}}$$

where $a_H$ is the spacing of body 17 from the cavity walls in plane $P_H$.

This relationship satisfies the conditions for ensuring that the moder operates with a wide passband, that the mode ratio increases with the frequency and that displacement of the excitation plane of the hybrid mode $EM_{12}$ takes place toward the left or, in other words, toward the source with increasing frequencies, with the result that length $L_H$ is larger than length $L_B$.

Figure 3:
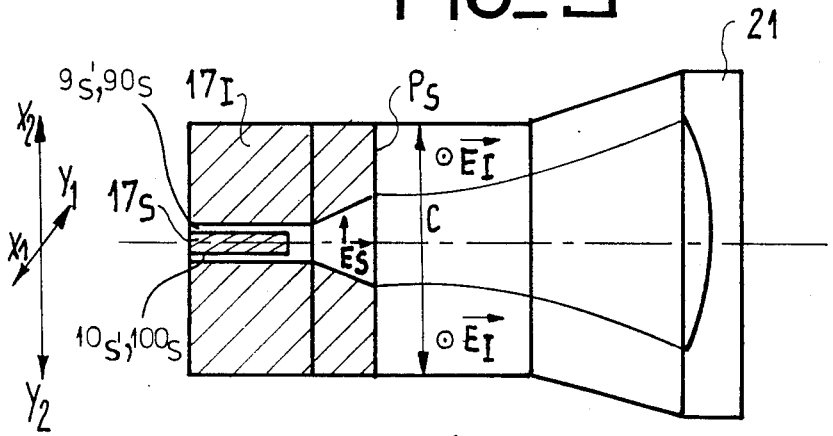
FIGS. 3 and 4 are an axial and a transverse sectional views respectively taken on lines III—III and IV—IV of FIG. 2.
Figure 4:
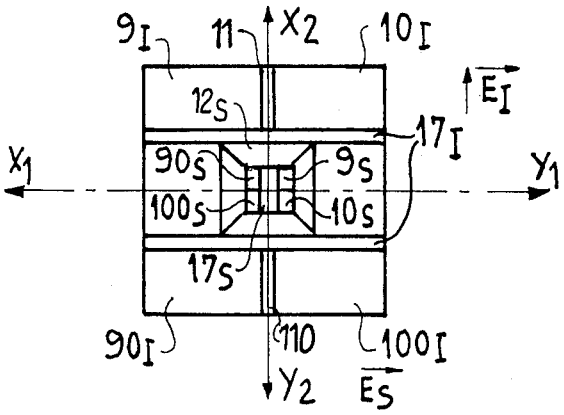

In FIGS. 2–4 we have used the same reference characters as in FIG. 1, supplemented by a subscript I when they relate to elements of the section operating at lower frequencies and by a subscript S when they relate to elements of the section operating at higher frequencies. There are thus shown two pairs of supply waveguides $\mathbf{9}_I$, $\mathbf{10}_I$ and $\mathbf{90}_I$, $\mathbf{100}_I$ which open at plane P into a cavity $\mathbf{12}_I$ and are separated by an obstruction $\mathbf{17}_I$ terminating in a flared-out horn $\mathbf{13}_I$ which defines the aperture plane $S_I$ of the lower-frequency section at its wide output end. FIG. 2 further shows a plane J corresponding to the section plane of FIG. 4. As is apparent from FIGS. 2–4, a second cavity $\mathbf{12}_S$ forming a flared-out second horn $\mathbf{13}_S$, whose output aperture lies in plane $P_S$, is located within the interior of the obstruction $\mathbf{17}_I$. Cavity $\mathbf{12}_S$ adjoins two further waveguide pairs $\mathbf{9}_S$, $\mathbf{10}_S$ and $\mathbf{90}_S$, $\mathbf{100}_S$ oriented perpendicularly to the larger pairs $\mathbf{9}_I$, $\mathbf{10}_I$ and $\mathbf{90}_I$, $\mathbf{100}_I$ and separated by block $\mathbf{17}_S$. It is further apparent that a lens 21 is placed in the plane $S_I$, made up of metal strips 22 arranged parallel to the horizontal electric field $\vec{E}_S$ of the higher-frequency section and thus transparent to the lower-frequency wave of vertical polarization $\vec{E}_I$. The effect of this lens, where focus is located in the plane $P_S$ (corresponding to plane $P_B$ of FIG. 1), is to convert the wave emitted by the higher-frequency section into an outgoing beam with planar wavefront. The diameter of the lens 21 is chosen so as to be larger than the angular aperture of the beam radiated in the plane $S_I$. The E planes of the lower-frequency and higher-frequency sections respectively extend in directions $X_1$-$Y_1$ and $X_2$-$Y_2$, each of these E planes bisecting the obstruction of the other section.

According to an important feature of our present invention, the plane $S_I$ is located in the Rayleigh zone of the higher-frequency wave which is extended by lens 21 to the interior of the Fraunhofer zone of the lower-frequency section, i.e. that the distance between aperture planes $S_I$ and $P_S$ is smaller than the extent of that Rayleigh zone in the direction of propagation. We prefer in practice to adopt midfrequency values of the two bands having a ratio in the vicinity of or higher than 10 in order to permit a simple mechanical implementation of this condition. The two blocks $\mathbf{17}_I$ and $\mathbf{17}_S$ are relatively proportioned in conformity with that ratio.

A particular example of construction of a source according to the invention has been produced by employing the so-called I-band of the order of 9 GHz as the lower-frequency band and the so-called M-band of the order of 94 GHz as the higher-frequency band. The M-band unit (novel designation of the W-band) is so designed that, in the plane $P_S$, the aperture parameters are respectively 16 mm and 40 mm. The distance $P_S$-$S_I$ is chosen in this case so as to be equal to 60 mm. It can be verified that, under these conditions, the plane $S_I$ is located in the Rayleigh zone of the section which operates within the M-band or higher-frequency band. It is recalled that this condition is essential for the practical application of the invention. Accordingly, the diameter of the lens 21 is 45 mm.

FIG. 5 is a schematic illustration of the use of a source according to our present invention in a Cassegrain-type antenna. The overall unit, aside from lens 21 is designated by the reference numeral 1. There is shown in chain-dotted lines the path of the wave emitted by the section which operates in the lower-frequency band with vertical polarization. The dashed line shows the path of the wave emitted by the section which operates in the higher-frequency band with horizontal polarization. A rearwardly convex semitransparent intermediate reflector 30 sends back the lower-frequency wave but is totally transparent with respect to the higher-frequency wave. Inasmuch as these two waves have mutually orthogonal polarizations, this condition can readily be satisfied by employing a reflector consisting of conductors which are suitably arranged with respect to the orientations of the two electric fields. The lower-frequency wave is returned by a forwardly concave principal reflector 31 to the right-hand portion of the Figure after having been subjected to a rotation of its polarization on a grid 33. The wave then passes through the semi-transparent reflector 30. The higher-frequency wave which has passed through the reflector 30 without attenuation, is totally returned by an outlying rearwardly convex reflector 32 which is formed of solid metal. The diameter of reflector 32 is chosen so as to take into account the dimension of the beam in the higher-frequency band as defined by the lens 21 of the two-band source. The entire microwave energy is directed by the principal reflector 31 centered on the waveguide structure 1, toward the right-hand portion of the Figure without any attenuation caused by the reflector 30.

In a particular antenna equipped with a source corresponding to the example given above, the reflector 32 employed had a diameter of 80 mm and a focal distance equal to 330 mm. The grid 33 adjacent the principal reflector 31, which rotates the plane of polarization of the lower-frequency wave through 90° in order to let it pass without attenuation through the intermediate reflector 30, is of a type well known to those skilled in the art. Reflector 31 is located in the Fraunhofer or far-field zone of the lower-frequency section.

What is claimed is:

1. A two-band multimode microwave source for the simultaneous radiation of waves in a lower-frequency band and in a higher-frequency band, comprising a waveguide structure forming a first cavity of rectangular cross-section and including two first pairs of waveguides which terminate at a discontinuity plane and are separated from each other by a first block projecting convergingly beyond said discontinuity plane into said first cavity, said first pairs of waveguides emitting into said first cavity a lower-frequency first wave, said first block being hollow and containing two second pairs of waveguides separated by a second block, said first block forming a second cavity communicating with said second pairs of waveguides and opening into said first cavity for emitting a higher-frequency second wave into the latter, said first cavity having an output aperture spaced from said second cavity in the direction of wave propagation for radiating both said first and second waves.

2. A microwave source as defined in claim 1 wherein said first pairs of waveguides and said first block have an orientation perpendicular to that of said second pairs of waveguides and said second block, said first and second waves having mutually perpendicular E-planes respectively bisecting said second and said first block.

3. A microwave source as defined in claim 1 or 2 wherein said first cavity terminates in a flared-out first horn defining said output aperture, said second cavity forming a flared-out second horn terminating at a further plane.

4. A microwave source as defined in claim 3, further comprising a metallic lens at said output aperture focusing said second wave into an outgoing beam with planar wavefront.

5. A microwave source as defined in claim 4 wherein said first and second waves have mutually perpendicular E-planes, said lens consisting of metal strips paralleling the E-plane of said second wave for letting said first wave pass through substantially unaltered.

6. A microwave source as defined in claim 5 wherein said output aperture is separated from said further plane by a distance which is smaller than the extent of a Rayleigh zone of said second wave in the direction of propagation.

7. A microwave source as defined in claim 6 wherein said second and first waves have frequencies related to each other in a ratio of at least 10:1.

8. A radar antenna adapted to radiate waves in a lower-frequency band and in a higher-frequency band, comprising:

a waveguide structure forming a first cavity of rectangular cross-section and including two first pairs of waveguides which terminate at a discontinuity plane and are separated from each other by a first block projecting convergingly beyond said discontinuity plane into said first cavity, said first pairs of waveguides emitting into said first cavity a lower-frequency first wave, said first block being hollow and containing two second pairs of waveguides separated by a second block, said first block forming a second cavity communicating with said second pairs of waveguides and opening into said first cavity for emitting a higher-frequency second wave into the latter with a plane of polarization perpendicular to that of said first wave, said first cavity having an output aperture spaced from said second cavity in the direction of wave propagation for radiating both said first and second waves;

a forwardly concave main reflector centered on said waveguide structure;

a rearwardly convex intermediate reflector forwardly of said main reflector, said intermediate reflector being transparent to said second wave while directing said first wave back onto said main reflector;

a rearwardly convex outside reflector forwardly of said intermediate reflector sending back said second wave substantially unaltered through said intermediate reflector to said main reflector; and a polarization-rotating grid adjacent said main reflector for making the polarization of said first wave codirectional with that of said second wave and enabling both said waves to be redirected forward by said main reflector via said intermediate reflector and past said outside reflector.

* * * * *